US005427464A

United States Patent [19]

Nakagawa

[11] Patent Number: 5,427,464

[45] Date of Patent: Jun. 27, 1995

[54] CAP WITH AIR PASSAGE FOR A WRITING INSTRUMENT

[75] Inventor: Tatsuhiro Nakagawa, Saitama, Japan

[73] Assignee: Ohto Kabushiki Kaisha, Tokyo, Japan

[21] Appl. No.: 207,159

[22] Filed: Mar. 8, 1994

[30] Foreign Application Priority Data

Jul. 28, 1993 [JP] Japan ..... 5-041057 U

[51] Int. Cl.[6] ..... B43K 9/00

[52] U.S. Cl. ..... 401/202; 401/213; 401/243; 401/247; 24/11 F

[58] Field of Search ..... 24/11 F, 11 P, 11 R; 401/202, 213, 243, 247

[56] References Cited

U.S. PATENT DOCUMENTS 2,489,144 11/1949 Lanoie ..... 24/11 F
5,000,603 3/1991 Isoda ..... 401/243 X
5,066,156 11/1991 Petrillo .

FOREIGN PATENT DOCUMENTS 3234514 3/1984 Germany ..... 401/213
5-500932 2/1993 Japan .
334570 9/1930 United Kingdom ..... 24/11 F
420164 11/1934 United Kingdom ..... 24/11 F
2246744 2/1992 United Kingdom ..... 401/213
1391958 4/1988 U.S.S.R. ..... 401/213

*Primary Examiner*—Steven A. Bratlie
*Attorney, Agent, or Firm*—Wenderoth, Lind & Ponack

[57] ABSTRACT

A cap is provided for a writing instrument to eliminate a potential threat to safety when swallowed. The cap permits easy assembly of an inner cap into an outer shell without using any tools. The cap has an outer shell and a tip seal member (inner shell) fitted in the outer shell to form an air passage therebetween. The outer shell has a rectangular recess at one end and an annular projection on the inner surface adjacent to a bottom edge of the rectangular recess, and snap-fit projection is engageable with a barrel of the writing instrument. The tip seal member has a coupling device for holding a clip, a plurality of first and second projections frictionally engageable with the inner surface of the outer shell so that when the coupling device of the tip sealing member is press-fitted to the rectangular recess, the first projections are engaged with the annular projection of the outer shell.

12 Claims, 5 Drawing Sheets

CAP WITH AIR PASSAGE FOR A WRITING INSTRUMENT

BACKGROUND OF THE INVENTION

1. The Field of the Invention

The present invention relates to caps for writing instruments which can provide means for permitting air to flow through the cap to thereby eliminate or minimize a potential threat to safety when swallowed.

2. Description of the Prior Art

Caps for writing instruments such as markers and pens which employ water-soluble ink, for example, are designed to have a substantially air-tight seal about the nib or pen-point of the instrument to prevent drying out of the ink. To this end, an attempt has been made to enclose the point or nib in an air-tight condition by using a relatively small sized inner cap element. In this attempt, the small sized inner cap is press-fitted into a relatively large outer casing which constitutes a cap for a writing instrument, and this inner cap provides an air-tight seal about the nib of the writing instrument. U.S. Pat. No. 5,066,156 (corresponding to International Publication WO91/14582 and Japanese Publication No. 5-500932) shows a writing instrument cap which will be explained briefly with reference to FIG. 7. In the known cap structure shown in FIG. 7, the cap includes an outer shell 23 which has a front opening and a rear opening. The cap also includes an integral tip seal member 20 which includes an open front end and a closed rear end and is fixedly positioned in the central region of the outer shell. An open front end of the tip seal member 20 is adopted to retain the end of a writing instrument barrel which carries a point or nib to provide a substantially air-tight seal about the point or nib. The tip seal member 20 is spaced apart from the inner surface of outer the shell 23 by a plurality of ribs 21. The ribs 21 are arranged to extend longitudinally so that the ribs 21 form a plurality of adjacent passageways. Recesses 22 are formed on the ribs 21 so that they can be pushed through flange 24 to engage a top surface of the flange 24 with a snap lock fit. Thus, the tip seal member 20 is locked about the flange 24 by the recess 22 and a top surface of the ribs 21.

The cap disclosed in U.S. Pat. No. 5,066,156, however, has disadvantages in that (1) the outer shell 23 is tapered toward a rear end thereof and the inner cap or tip seal member 20 must be forcibly fit into the outer shell 23 by using a tool such as a pushing rod or the like, resulting in an inefficient assembly of the tip seal member into the outer shell, (2) the recess 22 of the tip seal member 20 and the flange 24 of the outer shell 23 do not provide a sufficiently large deformation and, accordingly, the fixture or coupling of the two elements must be established by a very small frictional engagement, and in some cases, the coupling portions are scraped or struck out by a successive forcible press-fit engagement operation, which results in loose engagement and unexpected disengagement of the inner cap or tip seal member 20 from the outer shell 23, and (3) the tip seal member 20 must provide an air-tight seal with respect to a barrel portion of the nib of the writing instrument and therefore a very accurate positional relation is required which, however, is not fully satisfied by only one engagement portion between the recess 22 and the flange 24 and, therefore, the tip seal member 20 is not fixed to the outer shell 23 with respect to all directional movements.

SUMMARY OF THE INVENTION

An object of the present invention is to provide a new cap for a writing instrument, which permits an easy assembly of the tip seal member (inner shell) into an outer shell without using any tools such as a pushing rod.

Another object of the present invention is to provide a new cap for a writing instrument which affords an accurate positioning of the tip seal member (inner shell) relative to the outer shell so that a reliable air-tight seal is obtained.

Another object of the present invention is to provide a new cap for a writing instrument which can prevent unexpected disengagement of the tip seal member (inner shell) from the outer shell.

According to the present invention, there is provided a cap for a writing instrument comprising an outer shell member and a tip seal member fitted in the outer shell member to form an air passage therebetween, wherein the outer shell member has a rectangular recess at one end, an annular projection on an inner surface thereof adjacent to a depth of the rectangular recess, and snap-fit projections engageable with a barrel of the writing instrument, the tip seal member has a coupling means, adaptable to the rectangular recess, on an outer surface thereof for fitting therein a clip, a plurality of first projections frictionally engageable with an inner surface of the outer shell member and a plurality of second projections frictionally engageable with the inner surface of the outer shell member, whereby when the coupling means of the tip sealing member is press-fitted to the rectangular recess, the first projections are engaged with the annular projection.

In the present invention, the inner cap, or tip seal member, can be easily inserted from the end where the rectangular recess is formed and the recess is engaged with the coupling means so that the tip seal member is non-rotatably and axially forwardly immovably fitted in the outer shell member. At the same time, the first projections (engaging projections) of the tip seal member are engaged with the annular projection so that the tip seal member is not dropped or removed from the outer shell. Further, the second projections (bracing projections) of the tip seal member contact the inner surface of the outer shell member and serve to prevent unnecessary radial movement of the tip seal member within the outer shell member.

DETAILED DESCRIPTION OF THE INVENTION

Figure 1:
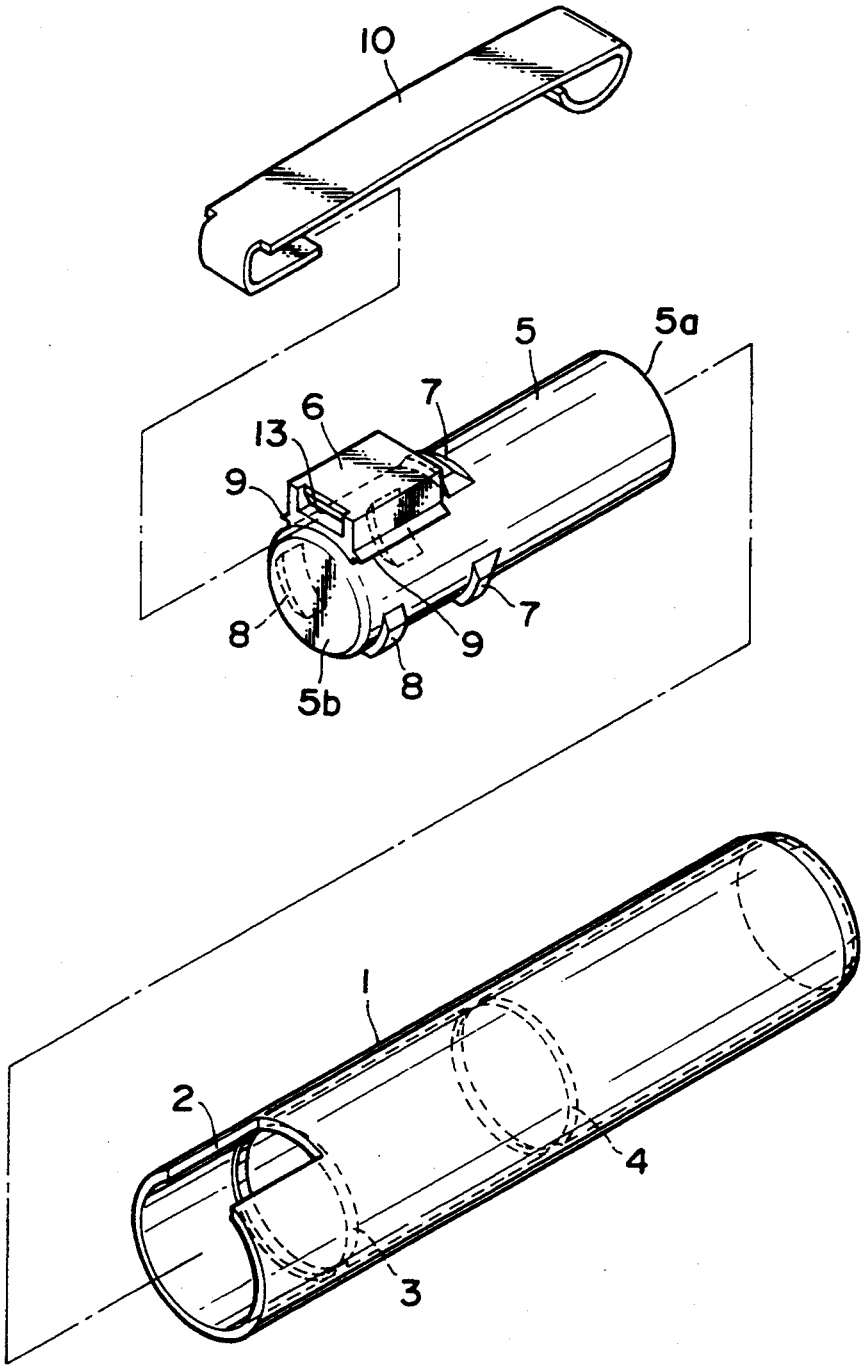
FIG. 1 is a fragmentary perspective view of a cap for a writing instrument according to the present invention.

Referring first to FIG. 1, a cap is made of a moldable polymeric material such as polyethylene or polypropylene and has an outer shell member 1 of a straight tubular shape with openings at the opposite ends thereof. The outer shell member 1 has a cut out or recess 2 which extends from one end to a certain length as illustrated. On the inner surface of the outer shell member 1, an annular projection 3 having a trapezoidal cross sectional shape is formed along the extended end, or bottom of the rectangular recess, and a snap-fit annular projection 4 having a semi-circular or arc shape is formed spaced from the position of the annular projection 3.

Figure 6:
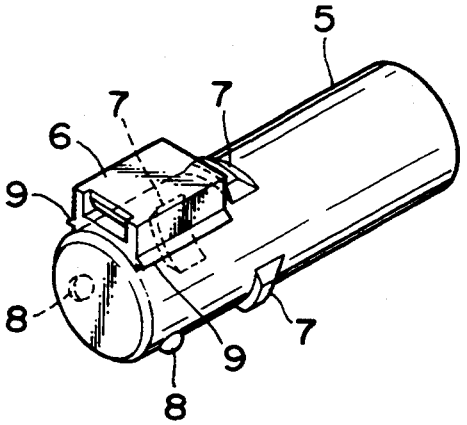
FIG. 6 is a perspective view of a cap in another embodiment of the present invention showing modified structure of second projection means.

The cap also has an inner shell or tip seal member 5 which is formed of the same material as that of the outer shell member 1. The tip seal member 5 is tubular and has an open front end 5*a* and a closed rear end 5*b*. A coupling member 6 having a slot 13 for receiving a bent portion of a clip 10 is disposed on an outer rear end portion of the tip seal member 5, and the tip seal member 5 has three engaging projections 7 having trapezoidal cross-sectional shapes and provided in a spaced confronting relation with respect to a bottom of the coupling member 6, and two bracing projections 8 at a deviated opposing positions on the circumferential rear end surface of the tip seal member 5. The bracing projections 8, which serve to prevent any unnecessary movement of the tip seal member 5 in the outer shell member 1, can be modified to a semi-spherical shape as shown in FIG. 6 and the clip 10 may be formed integral with the tip seal member 5, although not shown. In the illustrated embodiment, the coupling member 6 has projecting ends (or flanges) 9 on opposing sides, each having a triangular shape in cross section so that the apexes of the triangular projecting ends 9 contact the side walls of the recess 2 of the outer shell member 1, but the projecting ends 9 can be omitted if desired.

Figure 2:
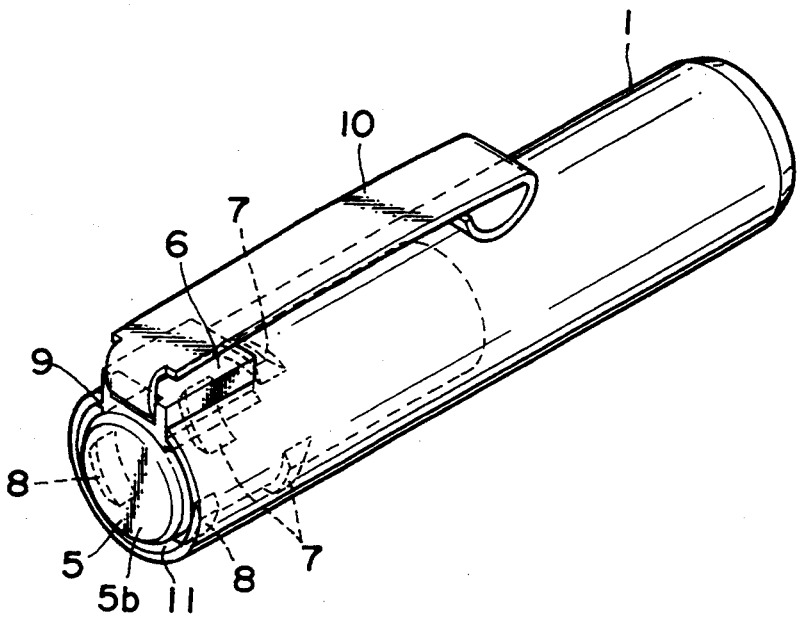
FIG. 2 is a perspective view of the cap shown in FIG. 1 with the parts assembled.

The engaging projections 7 and the bracing projections 8 are formed such that the outer diameters OD thereof are substantially equal to an inner diameter ID of outer shell member 1, and such that the coupling member 6 of the tip seal member 5 has a size which is large enough to fit to the recess 2 of the outer shell 1, so that the tip seal member 5 can be inserted into the recess 2 of the outer shell 1 by a finger tip operation until the closed rear end 5*b* of the tip seal member 5 slightly projects from the rear end of the outer shell 1 as shown in FIG. 2. In the illustration of FIG. 2, the annular projection 3 and snap-fit projection 4 are omitted for simplification only. In the drawing figures, reference numeral 11 represents an air passage which is formed between the inner surface of the outer shell 1 and the outer surface of the tip seal member 5.

Figure 3:
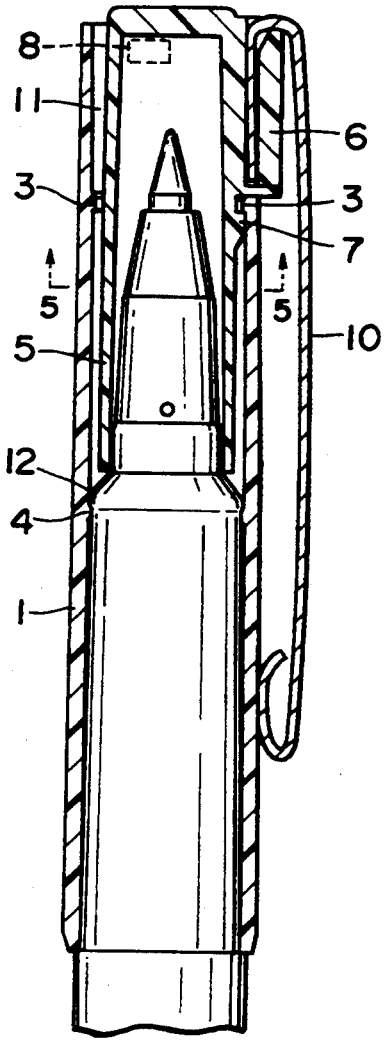
FIG. 3 is an elevational section of the cap shown in FIG. 2 with a writing instrument mounted therein.

With reference to FIG. 3, the cap of the present invention as described above is adapted to receive a writing instrument so that the snap-fit projection 4 rides over an annular projection 12 which is formed on an outer surface of the barrel of the writing instrument. Thus, the cap is suitably engaged with the barrel of the writing instrument, and at this moment, an air-tight seal is formed by the engagement between the annular projection 12 of the writing instrument and the snap-fit projection of the outer shell 1. FIG. 3 also shows that the tip seal member 5 is immovable in circumferential and longitudinal directions by the engagement between the coupling member 6 and the recess 2 of the outer shell 1, and that the engagement between the engaging projections 7 of the tip seal member 5 and the annular projection 3 of the outer shell 1 prevents the tip seal member 5 from being dropped out of the outer shell 1.

Figure 4:
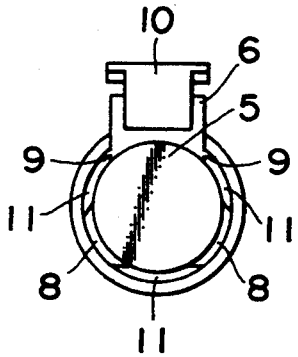
FIG. 4 is a plan view of the cap shown in FIG. 3 as seen from a rear end thereof.
Figure 5:
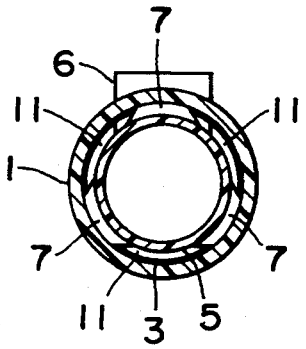
FIG. 5 is a sectional view of the cap, taken along line 5—5 in FIG. 3.
Figure 7:
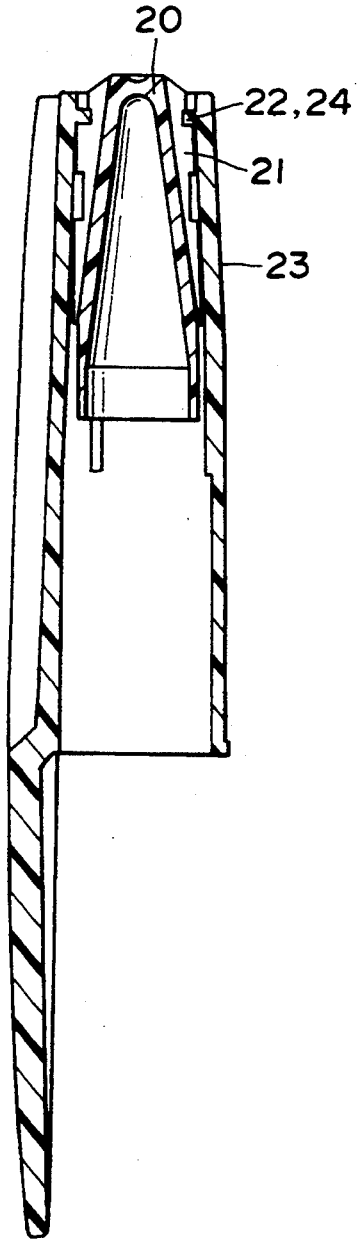
FIG. 7 (PRIOR ART)
FIG. 7 is a sectional view of a prior art cap for a writing instrument.

As shown in FIG. 4, the bracing projections 8, which are provided in a slightly deviated opposed relation as shown, are contacted with the inner circumferential surface of the outer shell 1. In FIG. 5, the engaging projections 7 of the tip-seal member 5 are contacted with the inner circumferential surface of the outer shell 1. According to the present invention, the cap can be easily assembled by merely inserting by manipulation the tip-seal member 5 from the rear end of the outer shell 1 without using a tool such as a pushing rod or the like. By the engagement between the coupling member 6 and the recess 2 of the outer shell 1, the tip-seal member 5 is fixed against rotation or movement in an axial and forward direction. Further, the engagement between the engaging projection 7 of the tip-seal member 5 and the annular projection 3 of the outer shell 1 can prevent the tip-seal member 5 from dropping out of the outer shell 1. In addition, the bracing projections 8 can prevent an undesirable radial movement of the tip-seal member 5 relative to the axis of the outer shell 1 and, accordingly, the tip-seal member 5 can be held in an accurate position within the outer shell 1. Thus, a reliable air-tight seal is obtained when the cap is mounted on the writing instrument.

What is claimed is:

1. A cap for a writing instrument, comprising a tubular outer shell member having a first end and a second end;

a tubular tip seal member having a first end and a second end, said tubular tip seal member being mounted in said tubular outer shell member with an air passage defined between said tubular outer shell member and said tubular tip seal member;

wherein said tubular outer shell member has a cut-out portion extending from said first end thereof in an axial direction to a predetermined position therealong;

wherein said tubular outer shell member includes an inwardly projecting annular projection extending about an entire circumference of an inner surface of said tubular outer shell member at an axial position of said tubular outer shell member adjacent said predetermined position to which said cut-out portion extends;

wherein said tubular outer shell member includes a snap-fit projection engageable with a barrel of the writing instrument;

wherein said tubular tip seal member includes a coupling member, mountable by press-fit in said cut-out portion of said tubular outer shell member, said coupling member having a clip-receiving recess formed therein;

wherein said tubular tip seal member includes a plurality of outwardly projecting first projections circumferentially and intermittently extending around an outer surface of said tubular tip seal member and frictionally engageable with the inner surface of said tubular outer shell member, and a plurality of outwardly projecting second projections circumferentially and intermittently extending around the outer surface of said tubular tip seal member and frictionally engageable with the inner surface of said tubular outer shell member; and wherein when said coupling member is press-fit in said cut-out portion of said tubular outer shell member said first projections of said tubular tip seal member are engaged with said annular projection of said tubular outer shell member.

2. A cap for a writing instrument as claimed in claim 1, wherein said coupling member includes, on opposing sides thereof, projecting flanges for retaining said coupling member in said cut-out portion of said tubular outer shell member.

3. A cap for a writing instrument as claimed in claim 1, wherein said coupling member includes, on opposing sides thereof, projecting flanges, each having a triangular cross-sectional shape with apexes thereof contacting side walls of said cut-out portion of said tubular outer shell member.

4. A cap for a writing instrument as claimed in claim 13, wherein said second projections are spaced from said first projections in an axial direction towards said first end of said tubular tip seal member.

5. A cap for a writing instrument as claimed in claim 1, wherein said cut-out portion comprises a rectangular cut-out portion.

6. A cap for a writing instrument as claimed in claim 1, wherein said air passage comprises at least one passage defined, at one axial position, between an adjacent pair of said first projections and, at another axial position, between an adjacent pair of said second projections or between said coupling member and one of said second projections.

7. A cap for a writing instrument, comprising a tubular outer shell member having a first end and a second end;

a tubular tip seal member having a first end and a second end, said tubular tip seal member being mounted in said tubular outer shell member with an air passage defined between said tubular outer shell member and said tubular tip seal member;

wherein said tubular outer shell member has a cut-out portion extending from said first end thereof in an axial direction to a predetermined position therealong;

wherein said tubular outer shell member includes an inwardly projecting annular projection extending about an entire circumference of an inner surface of said tubular outer shell member at an axial position of said tubular outer shell member adjacent said predetermined position to which said cut-out portion extends;

wherein said tubular outer shell member includes a snap-fit projection engageable with a barrel of the writing instrument;

wherein said tubular tip seal member includes a coupling member, press-fit in said cut-out portion of said tubular outer shell member, said coupling member having a clip-receiving recess formed therein;

wherein said tubular tip seal member includes a plurality of outwardly projecting first projections circumferentially and intermittently extending around an outer surface of said tubular tip seal member and frictionally engaged with the inner surface of said tubular outer shell member, and a plurality of outwardly projecting second projections circumferentially and intermittently extending around the outer surface of said tubular tip seal member and frictionally engaged with the inner surface of said tubular outer shell member; and wherein said first projections of said tubular tip seal member are engaged with said annular projection of said tubular outer shell member.

8. A cap for a writing instrument as claimed in claim 7, wherein said coupling member includes, on opposing sides thereof, projecting flanges for retaining said coupling member in said cut-out portion of said tubular outer shell member.

9. A cap for a writing instrument as claimed in claim 7, wherein said coupling member includes, on opposing sides thereof, projecting flanges, each having a triangular cross-sectional shapes with apexes thereof contacting side walls of said cut-out portion of said tubular outer shell member.

10. A cap for a writing instrument as claimed in claim 7, wherein said second projections are spaced from said first projections in an axial direction towards said first end of said tubular tip seal member.

11. A cap for a writing instrument as claimed in claim 7, wherein said cut-out portion comprises a rectangular cut-out portion.

12. A cap for a writing instrument as claimed in claim 7, wherein said air passage comprises at least one passage defined, at one axial position, between an adjacent pair of said first projections and, at another axial position, between an adjacent pair of said second projections or between said coupling member and one of said second projections.

* * * * *